US005849099A

United States Patent [19]

McGuire

[11] Patent Number: 5,849,099

[45] Date of Patent: Dec. 15, 1998

[54] METHOD FOR REMOVING COATINGS FROM THE HULLS OF VESSELS USING ULTRA-HIGH PRESSURE WATER

[76] Inventor: Dennis McGuire, 2948 SE. Monroe St., Stuart, Fla. 34997

[21] Appl. No.: 618,377

[22] Filed: Mar. 19, 1996

Related U.S. Application Data

[63] Continuation of Ser. No. 374,189, Jan. 18, 1995, abandoned.

[51] Int. Cl.[6] ..... B08B 3/02; B08B 5/00; B08B 7/04

[52] U.S. Cl. ..... 134/10; 134/30; 134/31; 134/34; 134/37; 134/38

[58] Field of Search ..... 134/10, 22.18, 134/30, 32, 31, 34, 37, 38, 95.2; 239/543, 544; 427/369, 378

[56] References Cited

U.S. PATENT DOCUMENTS

| | | | |
|---|---|---|---|
| 2,235,258 | 3/1941 | Jones | 239/544 |
| 2,768,101 | 10/1956 | Fairchild | 134/38 X |
| 2,928,611 | 3/1960 | Lauderback et al. | 239/544 |
| 3,120,346 | 2/1964 | Willhoite | 239/214.13 |
| 3,576,222 | 4/1971 | Acheson et al. | 175/67 |
| 3,792,907 | 2/1974 | Anderson | 299/17 |
| 4,337,899 | 7/1982 | Selberg | 239/543 |
| 4,398,961 | 8/1983 | Mason | 134/37 X |
| 4,439,954 | 4/1984 | Bennett | 451/76 |
| 4,443,271 | 4/1984 | Goerss | 134/34 |
| 4,469,526 | 9/1984 | Budinsky et al. | 134/25.4 |
| 4,537,639 | 8/1985 | Shook | 134/34 |
| 4,552,594 | 11/1985 | Voskuilen et al. | 134/34 |
| 4,554,025 | 11/1985 | Burke et al. | 134/37 |
| 4,715,538 | 12/1987 | Lignau | 239/248 |
| 4,715,539 | 12/1987 | Steele | 239/263 |
| 4,923,120 | 5/1990 | Hammelmann | 239/252 |
| 5,024,382 | 6/1991 | Shook et al. | 239/11 |
| 5,078,161 | 1/1992 | Raghavan et al. | 134/16 |
| 5,080,286 | 1/1992 | Morrison | 239/543 |
| 5,096,122 | 3/1992 | Abramoska | 239/252 |
| 5,116,425 | 5/1992 | Ruef | 134/17 |
| 5,149,379 | 9/1992 | Gotoh | 134/10 |
| 5,167,721 | 12/1992 | McComas et al. | 134/32 |
| 5,217,163 | 6/1993 | Henshaw | 239/101 |
| 5,226,597 | 7/1993 | Ursic | 239/11 |
| 5,263,504 | 11/1993 | Bailey et al. | 134/176 |
| 5,320,682 | 6/1994 | Good et al. | 134/38 |
| 5,355,823 | 10/1994 | Goldbach et al. | 114/222 |

OTHER PUBLICATIONS

"Components," Copyright by WOMA, Nov., 1992 edition, and 4 pages.

*Primary Examiner*—Arlen Soderquist
*Assistant Examiner*—Saeed Chaudhry
*Attorney, Agent, or Firm*—Gary M. Nath; Nath & Associates

[57] ABSTRACT

A method for removing surface coatings from the hull of a ship by focusing annular streams of ultra-high pressure water from a rotating nozzle having one or more orifices. The nozzle orifices have oblique angles from the central axis of the rotating nozzle whereby the force of the water leaving the nozzle through the orifice imparts an opposite rotational force to the rotating nozzle. The placement of the orifices on the rotating nozzle is done in such a manner that the annular streams of water act in concert when striking the working surface to remove the paint. A waste water recovery system collects waste water and particulates of paint stripped from the working surface, the particulates are removed for later disposal and the water is recycled.

9 Claims, 2 Drawing Sheets

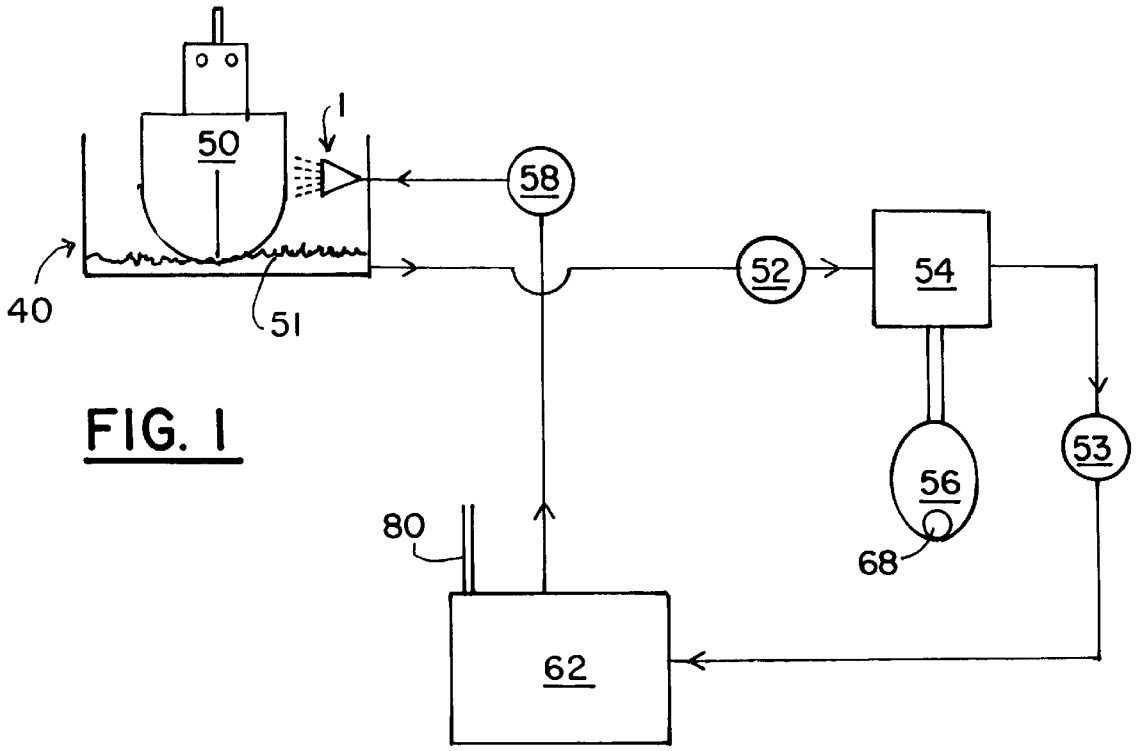
FIG. 1
FIG. 2
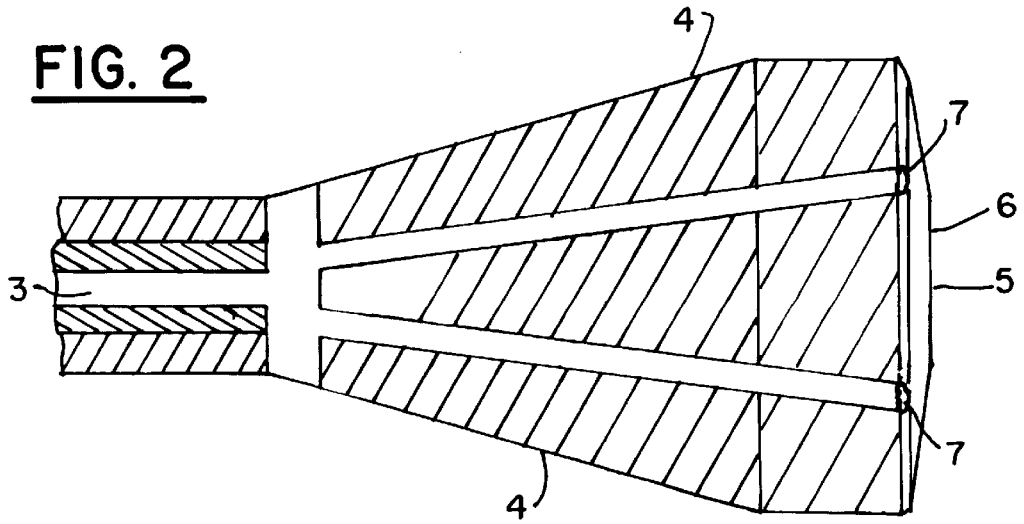

METHOD FOR REMOVING COATINGS FROM THE HULLS OF VESSELS USING ULTRA-HIGH PRESSURE WATER

This application is a Continuation of U.S. patent application Ser. No. 08/374,189, filed Jan. 18, 1995 now abandoned. The entire contents of which are incorporated herein by reference.

BACKGROUND OF THE INVENTION

1. Field of the Invention

The present invention pertains to a method for the removal of surface coatings from various surfaces. In particular, this invention pertains to a method of using ultra-high pressure water to remove surface coatings, namely paint from the hulls of ships to fully expose metal hull surfaces.

2. Description of the Prior Art

Modern cleaning systems often use a fluid jet to remove rust, scale or coatings from a surface to be cleaned. The use of a fluid carrying an abrasive such as garnet, crushed ice, silica sand, black beauty, or plastic is well known and commonly utilized to clean surfaces such as metal down to the bare metal surface. In several systems, the use of a fluid without an abrasive material would not effectively clean the surface to the desired level.

It is sometimes undesirable to use an abrasive carried in a fluid, since the abrasive may escape from the fluid and be mixed into the air surrounding the cleaning area and get into nearby machinery. Sand and coal blasting produce air pollution hazards and require containment barriers. Governmental regulations addressing environmental concerns have severely effected traditional abrasive blasting. In many countries, when performed to the letter of the law, traditional abrasive blasting requires total containment and negative vacuum dust collectors. Total enclosure of modern commercial vessels is not only cost prohibitive, but a time consuming project.

To reduce these chemical risks, strippers have been substituted for abrasive cleaners but are hazardous waste themselves and require special handling and disposal.

If an abrasive substance is used, the abrasive, such as sand, calcium, coal slag or other removal agent becomes contaminated with particulate paint, and must be treated as hazardous waste. Hazardous waste disposal is costly and can be environmentally hazardous. To clean the paint from the hull of one ship many tons of abrasive may be required, all of which will have to be treated as hazardous waste, even though the actual paint contaminate by itself may weigh only a few hundred pounds. For example, the use of one ton per hour of an abrasive utilizing a cleaning rate of 100 square feet of surface preparation per hour, yields a minimum of ten tons of non-reuseable abrasive contaminated with paint chips.

All of the above factors, including air pollution, containments, cost prohibitive equipment, handling and disposal of costly abrasive, transportation and landfill fees, are deficiencies found in most of the traditional prior art methods. As such, modern ship yards are increasingly constrained by regulation and economics from using traditional methods to strip the hulls of ships.

Not only have environmental pollution difficulties hindered shipowners, but the need for superior surface finish in order to extend the life of the coatings on ships. Astute shipowners realize a superior surface finish extends the life of the coatings and reduces drydock time and expenses in the future.

Various methods to remove coatings have been described in the prior art. Representative examples of such systems are as follows.

Henshaw, U.S. Pat. No. 5,217,163, discloses a rotating head which creates cavitation in a pressurized fluid such that a surface may be quickly and efficiently cleaned. The rotation of the nozzle ensures a relatively wide cleaning path. The cavitation allows cleaning using only the pressurized fluid jet without any necessary abrasive, while still fully utilizing high rotational speeds. A preferred cavitating jet nozzle is also disclosed for producing cavitation in the pressurized fluid. The cavitating jet nozzle includes a pin received at a central position which lowers the pressure of the pressurized fluid such that cavitation bubbles form in the fluid. The pin is self-centering within the nozzle since it is free floating relative to a securing member which retains the pin in the nozzle. In addition, the pin preferably has an end face upstream of an outlet portion of the nozzle.

Bailey et al. in U.S. Pat. No. 5,263,504 discloses an apparatus and method for removing a coating of undesirable material from a substrate by impacting the coating with narrowly focused streams of fluid discharged at high velocity from nozzle tips rotated rapidly by a nozzle head during linear, relative movement between the nozzle head and the coated substrate. The nozzle head may be rotated by a motor or self-actuated by tilting the tips out of the plane of the spin axis. Specific applications are described for descaling metal, cleaning electrolytic bath deposits from electrodes, and removing resinous materials from metal surfaces.

Van Sciver et al. in U.S. Pat. No. 5,232,514 discloses an alkaline blast cleaning system for aluminum surfaces which avoids discoloring or tarnishing of the aluminum surfaces. The system is comprised of an alkali metal bicarbonate having a particle size of from about 50 to about 1000 and an aqueous solution of sodium silicate. The sodium silicate is present in the aqueous solution in a corrosion inhibiting concentration of from about 100 to about 1000 ppm.

Enomoto et al. in U.S. Pat. No. 5,305,361 discloses a water jet peening method in which a pressurized water jet flow containing cavities is jetted through a nozzle having a velocity increasing orifice portion and a horn-like jetting hole formed continuously with the velocity increasing orifice portion to impinge against a surface of a metallic material immersed in water. In this way, it causes the cavities to collapse at the surface of the metallic member. A tensile plastic deformation is caused in a surface layer of the metallic material by local high pressure generated by the impingement and the collapse so that a residual tensile stress in the surface of the metallic member is reduced.

Ruef in U.S. Pat. No. 5,116,425 discloses a cleaning method and associated apparatus that are particularly useful for cleaning surfaces formed of relatively hard materials such as group or industrial rolls which are contaminated with relatively hard embedded deposits of undesirable materials that are difficult to remove by conventional washing or abraded cleaning methods. Ruef also reduces the effluent resulting from the cleaning step so that the cleaning method may be conveniently used in areas where effluent disposal may be a problem, such as smaller indoor rooms, areas, or equipment. The method comprises pressurizing a cleaning liquid with a gas driven hydraulic pump and directing a flow of the cleaning liquid from a nozzle at surfaces to be cleaned at a pressure of at least about 5,000 pounds per square inch (psi) and at a volumetric flow rate of no more than about 1.5 gallons per minute (gpm). The pressure created is sufficient to remove from the surface deposits that cannot be removed by mechanical scrubbing using tools or chemical detergent action other than by damaging the surface itself.

Anderson, U.S. Pat. No. 3,792,907, relates to a method of hydraulically separating asphalt topping from a pavement substrate, as opposed to mechanically tearing the bond between the two layers of material. This method results in significantly less damage to the layer, and is accomplished with the use of a high velocity water jet.

Raghavan et al. in U.S. Pat. No. 5,078,161 discloses an apparatus to remove rubber from an airport runway surface which comprises a manifold arm which rotates at as high as two thousand five hundred rpms over the runway surface. The device uses a plurality of water jets at high pressure (e.g. thirty five thousand psi). Even though the water pressure as at a level several times higher than that at which damage to the runway surface can occur, there is no noticeable damage to the runway surface.

None of these prior art systems have been effective to remove the surface coatings of a ship hull without the concurrent environmental hazards associated with the removed substrate. For this reason, it is desirable to develop a cleaning system that utilizes a fluid jet which is able to clean the surface of a ship and which does not carry an abrasive material. The present invention overcomes the prior art deficiencies by providing a method of using ultra-high pressure water jet technology by using direct impingement of the water to loosen and remove the paint by directing streams of water against the hull of a ship at pressures in excess of 25 thousand pounds per square inch. Additionally, the present invention reduces the amount of waste product that is environmentally hazardous. Water is the sole abrasive and as such it can be filtered, the hazardous particulates removed, and then recycled and returned to be reused as a stripper or disposed of without polluting the environment. Thus, hull stripping, which previously produced tons of contaminated sand or coal slag, and required expensive hauling of the contaminated abrasive to an approved landfill for disposal, now only produces a few fifty-five gallon drums of stripped paint which is more readily disposed of.

Further, it has been found that not only is there no noticeable damage to the hull surface, but the cleaning operation itself is accomplished very efficiently, and the hull surface is virtually free of contaminants. Traditional methods of stripping paint from the hull of a ship often times scored the metal substrate, leaving peaks and valleys on the surface of the metal. Coats of paint subsequently applied to the metal adhered to the peaks, leaving gaps between the paint and the substrate which weaken the adhesive strength of the coating. The present invention does not score the surface of the metal, thus allowing uniform adhesion. The present invention also removes contaminants, especially chlorides and sulfides, preventing the future encroachment of rust on the cleaned area which also improves the adhesion characteristics of paint coatings subsequently applied to the stripped metal. As such, the present process is: (1) less expensive than traditional abrasive blasting; (2) faster than traditional abrasive blasting; (3) produces a far superior surface than traditional abrasive blasting; and (4) significantly extends the life of coatings and reduces drydock time.

SUMMARY OF THE INVENTION

One embodiment of the present invention involves a method for removing surface coatings from a metal vessel hull, which comprises, directing a water jet of sufficient pressure to remove the surface coatings from a vessel hull to fully expose the metal hull substrate.

In a particularly preferred embodiment, the process also involves the additional steps of collecting the water and surface coating particles removed from the vessel hull, transferring the water and surface coating particles into a water transfer means, separating the water from the surface coating particles by a particle separating means to prepare recyclable water; collecting the surface coating particles for disposal; and pumping the recyclable water to a water storage means for future reuse.

In a further embodiment a method of removing surface coatings from a vessel hull, comprises, providing water under pressure to a nozzle, said nozzle being symmetrical, having a central axis, proximate and distal ends and further having a central conduit for the passage of pressurized water, and a plurality of orifices in said nozzle distal end wherein each of said orifices is connected to said central conduit by a radial port, wherein the orifices have a central axis which is oblique to the central axis of said housing and wherein the passage of the water through said orifice forms an annular stream of water, and said oblique angle of said orifice central axis directs the stream of pressurized water to a working surface wherein said annular streams cooperatively score said working surface; and directing the pressurized water to impact on the surface of a ship hull to remove the surface coatings.

Another feature of the invention involves a method of removing paint from a metal vessel hull, which comprises, providing pressurized water to a rotating nozzle said nozzle comprising a conduit to conduct said pressurized water to its distal end: providing a plurality of orifices in said rotating nozzle wherein the central axis of each individual orifice is oblique to said rotating nozzle central axis; selecting said orifices lateral displacement on said rotating nozzle and said orifice oblique angle to converge the individual annular streams of pressurized water at a focal point; and directing the pressurized water to impact on the surface of a ship hull wherein the rotation of said orifice directs said annular stream of pressurized water in a circular pattern on said surface, said oblique angles of said orifice causing the plurality of annular streams to trace separate circular patterns on said surface wherein the said pressurized water removes paint from said surface through direct and transverse force vectors.

BRIEF DESCRIPTION OF THE DRAWINGS

FIG. 1 is a view of an ultra-high pressure stripping system including a method to recover the water after impingement, filter it to remove the paint particles and to recycle the water and dispose of the waste paint particles.

FIG. 2 is a rotating nozzle head capable of providing sufficient water jet pressure to remove paint from the hull of a ship.

DETAILED DESCRIPTION OF THE PREFERRED EMBODIMENTS

Figure 3:
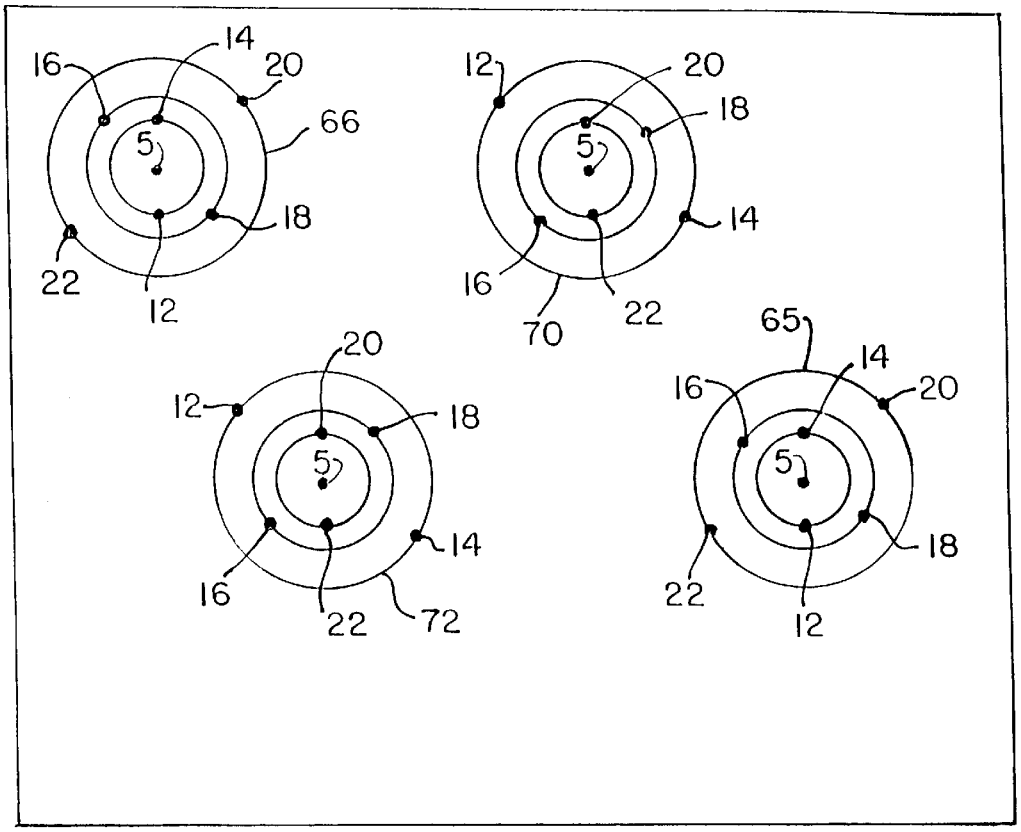
FIG. 3 is a view of a multi-nozzle stripping apparatus designed to remove coatings from a hull.

The present inventive subject matter relates to removing surface coatings from a hull of a vessel and more particularly to removing the surface coating all the way to the bare metal surface, also referred to as the "white metal". The process basically involves the use of water at very high pressures which when directed to the hulls surface strips away all surface coating layers. As used herein the term "surface coating" refers to all materials that are adhered to the white metal and include without limitation, paint, salt, minerals, rust, dirt, plant and animal growth matter such as algae and barnacles, welding material and materials used to patch the surface of the hulls to prevent water leaks, and mixtures thereof.

A water jet directing means supplies an ultra high pressure water jet against the hull of a vessel. The effect of the water jet on the surface depends on the pressure of the jet, and in the present invention the pressure of the jet is raised to a level significantly above that which was perceived to be adequate or desirable in the prior art without causing harm to the metal surface. The result of this action causes a very effective removal of the coating from the vessel hull, while causing no noticeable damage to the underlying metal surface.

The water jet is directed at the hull of the ship at sufficient pressure until the surface coating, including paint, is totally removed and bare "white metal" remains. The water jet should be at a pressure which is greater than twenty five thousand pounds per square inch and desirably greater than thirty thousand pounds per square inch. It has been found that a preferred practical range is between 35,000 and 60,000 psi, even though still higher pressure may also be used with caution.

The water jet directing means is preferably a nozzle or a plurality of nozzles arranged to discharge a plurality of water jets to increase coverage of the area to be stripped. The nozzle may be rotated either by the force of the water exiting the nozzle at an oblique angle or by pressurized air applied to the proximate end. Utilizing the present invention, the water flow utilized can be as low as about five gallons per minute and as high as fifty gallons per minute. Multiple water jet systems may also be used.

For the procedures described herein, the diameter of the nozzle is preferably in the range of about three to eight inches with a nozzle length of from about four to eight inches. The distance between the orifice openings on the nozzle and the surface of the substrate to be cleaned is preferably such that the water velocity at impact is sufficient to remove at least a majority of the coating material within the water stream impact pattern provided by a single pass of one nozzle. To accomplish this result, the discharge velocity at the orifice opening is preferably sufficient to provide a water velocity at least about 1,500 ft/sec. Higher impact velocities may be desirable and may be achieved by increasing the water pressure, for example up to about 60,000 psi, and by sizing the orifice bore to provide a higher discharge velocity, for example up to about 3,000 ft/sec. By achieving these velocities, it is possible to clean the surface of a ship hull at a rate of about 150 to about 400 $ft^2$/hour, and preferably from about 200 to 300 $ft^2$/hour.

FIG. 1 depicts a method to remove paint from the hull of ship 50, by directing ultra-high pressure water by means of nozzle 1 against the hull of ship 50.

The vessel hull to be treated may be positioned in a floatable drydock, removed from the water and treated on land, or the area treated may be surrounded by a cofferdam. The exact location of the vessel is not critical except that it not be in contact with the water used to keep it floating on the surfaces to be treated.

The water is pressurized by pumping means 58 which may be any convention high compression pump capable of achieving the water pressure desired. The residue 51 which falls from the ship hull during cleaning or is vacuum removed, by means not shown, is then recovered in reservoir 40. The residue contains water and surface coating matter removed from the hull surface coating matter and water is then transferred by pump 52 to filter means 54 to remove the particles from the water.

Filtering means 54 may be any standard design capable of handling large volumes of liquid containing suspended particles including those such as Stuzman, U.S. Pat. No. 5,271,850, or Schoss U.S. Pat. No. 5,298,176. The particles of paint are collected, in waste storage tank 5G, for further processing and handling. The water is transferred by pump 53 to holding tank 62 to be used again as a stripper agent. Additional water may be added to holding tank 62 via water inlet 80 as required. The particulate matter is removed from waste storage tank 56 via hopper 68 for proper hazardous waste disposal.

When needed during cleaning, the water is removed from holding tank 62 and passed by pump 58 to nozzle 1 to be applied to the hull surface to be treated.

While the above description has been directed towards a method to remove paint from the surface of the hull of a waterborne vessel, it is within the scope of the present invention to remove paint from other surfaces such as rolling stock, automobiles, trucks, aircraft, storage tanks, or other structures that would benefit from ultra-high water pressure cleaning.

Important characteristics of the high pressure water pump 58 include its capacity and horsepower, which are closely related to the flow rate and pressure at which water is ejected through the nozzle. A rotating nozzle head in conjunction with a ultra-high pressure pump will provide sufficient pressure to remove the paint while minimizing the reactive thrust of the water leaving the nozzle opening to a backward motion pressure of from about 20 to about 100 PSI. Such low backward pressures enable the user to operate the apparatus for sustained periods without the need for mechanical assistance, such as a boom, supports or cranes.

Without being limited to a particular ultra high pressure pump system, it should be recognized at any commercially available positive displacement, pump, such as a plunger pump may be used herein. An exemplary plunger pump would be one that is rated 5.5 gpm (20.82 lpm) at 30,000 psi (2,075 bar). The pumping system may also include standard features such as A. In-line valve design pumphead.

B. Liquid filled pressure gauge.

C. Automatically resetting full lift safety valve.

D. Stainless steel packing cylinders.

E. Nickel coated tungsten carbide plungers for high load capacity.

F. Pressurized gear end lubrication system through a forced and flame hardened drilled crankshaft.

G. Gear end oil cooling system.

H. Direct drive system.

I. Suction side booster pump to maintain suction pressure on-site.

J. Stainless steel 20 gallon (75.71 liter) reservoir tank.

K. Suction flow stabilizer with combination single filter, equipped with three cartridges for 10 micron filtration.

L. Suction line pressure sensor.

M. Pneumatic—mechanical throttle control.

N. Pulsation dampener.

In addition, the engines may be water cooled diesel engines rated at 136 hp at 1800 rpm.

Furthermore, the pump system may be inserted in a water-tight container for use on site to avoid degradation problems associated with atmospheric salt water deposits.

FIG. 2 depicts an example of a nozzle that can be used herein. Nozzle 1, having distal end 6, proximate end 2, and conduit 3 to conduct pressurized water via radial ports 4 to a plurality of orifices 7 wherein the central axis of each individual orifice 7 is oblique to central axis 5 of nozzle 1. By selecting the lateral displacement of orifice 7 on distal end 6, in combination with the orifice oblique angle, the individual annular streams of pressurized water can be converged at a focal point to remove paint from the surface through direct and transverse force vectors. By carefully controlling the angles at which orifices 7 are positioned, and the rotational forces resulting therefrom, it is possible to utilize ultra-high water pressure to effectively clean the working surface being treated. Because the forward thrust of the water suffers some efficiency loss through the nozzle the greater the pressure supplied to the nozzle input, the greater the thrust of the water streams on the working surface.

FIG. 3 depicts several nozzle configurations for four separate nozzles. The orifice configuration of each nozzle can be identical to that of the other nozzles or configured independently. In the figure depicted the configuration of nozzles 66 and 65 are identical and nozzles 70 and 72 are identical to each other but form different patterns of water than nozzles 65 and 66. Such an apparatus has a selection function with which to enable or disable individual nozzles depending on the type of coating to be removed and the configuration of the orifices on a given nozzle. Nozzles 66 and 65 have orifice pair 20, 22 with the greatest oblique angle the farthest from central axis 5, with the remaining orifices 12, 14, 16 and 18 placed in descending angle order proximate to nozzle central axis 5. This embodiment allows the annular streams to diverge, with the rotation of nozzle 1 causing the water leaving from the orifice pair to form an annular stream wherein the stream of the second orifice in the pair follows the path of the first orifice. This configuration allows for greater surface coverage as the nozzle is moved linearly across the work surface. Nozzles 70, 72 have orifice pair 20, 22 with the greatest oblique angle located closest to central axis 5, and the remaining three orifice pairs 12, 14, 16, and 18, are placed at an increasing distance from central axis 5 in inverse order of their oblique angles. This will cause the streams of water to first converge before diverging.

The present method enables the surface of the hull to be cleaned to the white metal surface. One procedure for measuring the extent of cleaning is to measure the Adhesion Values of a subsequent coating applied to the bare metal. In this way, a measurement value is obtained which correlates to the extent of cleaning. As discussed above, prior art procedures for cleaning surfaces with abrasive, results in the formation of non-uniform surfaces. Such surfaces routinely exhibit ridges and valleys, which adversely impact on the adhesion of paints to its surface.

The Adhesion Value test measures the force needed to separate a coating from a metal substrate. The test is performed in accordance with ASTM D-4541-85 "Pull-off Strength of Coatings Using Portable Adhesion Testers". This method involves attaching a loading fixture to the surface of the primer with a high strength epoxy glue. After the glue has been allowed to cure, an adhesion tester is attached to the loading fixture and tension is applied. The tension is increased until failure occurs. Using the present process, an Adhesion value from about 800 to about 2,500 psi are routinely obtained. In contrast, surfaces cleaned by conventional procedures generally exhibit Adhesion Values of about 400 pounds per square inch.

In addition to cleaning rate, it is also important to carefully analyze salt and chloride levels, as well as levels of traditional abrasives left behind in the surface valleys following treatment. Traditional abrasive blasting leaves surface steel with chloride levels around 400% higher than the present process. Furthermore, traditional abrasive blasting produces chloride levels of 20 micrograms per cubic centimeter, as compared to less than 10 and preferably less than 5 micrograms per cubic centimeter with the present process. It is recognized that there is a direct correlation between coatings failures and high salt levels. The more salt remaining on a prepared surface, the lower the adhesion levels, and the shorter the life of the coating. The present process removes 75% more salt and surface contaminants than traditional abrasive blasting and significantly extends the life of the coating.

In a particularly preferred feature of the invention, once the hull surface has been treated it is then blown dry with air. It has been unexpectedly found that blowing the surface of the hull dry with an air blowing means immediately after stripping reduces the level of sulfide and chloride contaminants remaining on the surface of the metal. As discussed above, the present invention allows levels of chlorides preferably below about 5 micrograms per square centimeter to be achieved. Such low levels aids in the inhibition and prevention of rust propagation and allows for better adhesion properties for subsequent coats of paint to be applied to the hull.

When using the air blowing process in combination with the present process a particularly preferred process is developed for removing paint from a vessel hull, which comprises the steps of directing a water jet of sufficient pressure to remove the paint from a vessel hull to fully expose the metal substrate by a water directing means, blowing the vessel hull dry after removing the paint wherein the chloride level on said hull is less than about ten micrograms per square centimeter and wherein the hull has a paint adhesion value greater than 700 pounds per square inch, collecting the water containing particles of the paint removed from the vessel hull, transferring said water to a particle separating means, separating the water from the paint particles by a particle separating means to form recyclable water, collecting the paint particles by a collecting means for disposal of same, pumping the recyclable water to a water storage means, and recycling the water to the water jet to remove additional paint.

The following examples are illustrative of preferred embodiments of the invention and are not to be construed as limiting the invention thereto. All percentages are based on the percent by weight of the system unless otherwise indicated and all totals equal 100% by weight. All pressures are measured as PSIg, that is pound per square inch gauge.

EXAMPLE 1

The aircraft carrier USS Roosevelt was treated by the process of the present inventive subject matter. The surface cleaned was measured by the Adhesion Value test.

The typical coating system used by the navy on hanger decks and flight decks consists of an epoxy primer and one coat of an aggregate-filled epoxy non-skid deck coating. Traditionally, the primer is applied to the deck after it is abrasive blast cleaned. The removal method of this invention was used to remove the old paint using ultra high pressure water at a pressure of 25,000 PSIg. This method removes the non-skid decking and primer, leaving a bare steel surface. The steel surface retained the abrasive blast pattern from previous removal and recoating operations. Two areas were prepared using the present process. One had an approximate area of 4 square feet, while the other hand an approximate area of 2 square feet. After the non-skid decking and primer were removed, the bare steel was coated with an epoxy primer, Devgrip 137 manufactured by Devoe Coatings.

In order to ensure that the epoxy primer developed adequate adhesion to the steel, an adhesion test was performed. The testing was done in accordance with ASTM D-4541-85, "Pull-off Strength of Coatings Using Portable Adhesion Testers".

The results of the adhesion test are set forth in Table I.

TABLE I

| Loading Fixture | Tension at Failure (psi) | Plane of Failure |
|---|---|---|
| #1 | 1500 | Glue/Primer |
| #2 | 1100 | Glue/Primer |
| #3 | 1400 | Glue/Primer |
| #4 | 1200 | Glue/Primer |
| #5 | 1300 | Glue/Primer |
| #6 | 700 | Glue/Primer |
| #7 | 1000 | Glue/Primer |
| #8 | 1200 | Glue/Primer |
| #9 | 1300 | Glue/Primer |
| #10 | 1000 | Glue/Primer |
| #11 | 1500 | Glue/Primer |
| #12 | 1000 | Glue/Primer |

The plane of failure of the paint tested was always at the interface between the glue and the primer. The primer was lightly sanded, then thoroughly cleaned with a dry rag. The failure was at the top surface of the primer where sanding had occurred. In all cases, the adhesion of the primer to the substrate prepared by the present process was greater than the cohesive strength of the top surface of the primer. In no case did any of the primer detach from the substrate. Since the adhesive strength of the primer to the substrate is somewhat higher than the cohesive strength of the top surface of the primer, the actual adhesive strength of the primer to the substrate cannot be determined using this method. Because no primer detached from the substrate, even when 1500 psi tension was applied, it is estimated that the actual adhesive strength was greater than 1500 psi.

The invention being thus described, it will be obvious that the same may be varied in many ways. Such variations are not to be regarded as a departure from the spirit and scope of the invention and all such modifications are intended to be included within he scope of the following claims.

What is claimed is:

1. A method for removing surface coatings from a metal vessel hull, which comprises:

directing a water jet of sufficient pressure to remove the surface coatings from the vessel hull to fully expose the metal hull substrate, said water jet issuing from a symmetrical nozzle housing having a central axis, proximate and distal ends, and a plurality of orifices, each of said orifices having a central axis laying on a line oblique to said central axis of said housing; and directing a stream of air at the vessel hull to blow the vessel hull dry to remove said surface coating and water, wherein a chloride level on said hull is less than about ten micrograms per square centimeter and the hull has a paint adhesion value greater than about 700 pounds per square inch.

2. The method of claim 1, further comprising:

collecting the water and surface coating particles removed from the vessel hull;

transferring the water and surface coating particles into a water transfer means;

separating the water from said surface coating particles by a particle separating means to prepare recyclable water;

collecting said surface coating particles; and pumping said recycling water to a water storage means.

3. The method of claim 2, further comprising:

recycling said water from the water storage means to the water jet to remove additional surface coatings.

4. A method for removing paint from a metal vessel hull, comprising the steps of:

providing pressurized water to a rotating nozzle, said nozzle comprising a conduit to conduct said pressurized water to its distal end;

providing a plurality of orifices in said rotating nozzle wherein the central axis of each individual orifice is oblique to said rotating nozzle central axis;

selecting said orifices lateral displacement on said rotating nozzle and said orifice oblique angle to converge the individual annular streams of pressurized water at a focal point;

directing the pressurized water to impact on the surface of a ship hull wherein the rotation of said orifice directs said annular stream of pressurized water in a circular pattern on said surface, said oblique angles of said orifice causing the plurality of annular streams to trace separate circular patterns on said surface wherein the said pressurized water removes paint from said surface through direct and transverse force vectors; and directing a stream of air at the vessel hull to blow the vessel hull dry to remove said paint and water, wherein a chloride level on said hull is less than about ten micrograms per cubic centimeter and the hull has a paint adhesion value greater than about 700 pounds per square inch.

5. A method for removing paint from a vessel hull, which comprises:

directing a water jet of sufficient pressure to remove the paint from said vessel hull to fully expose a metal substrate of said vessel hull by means of a water directing means;

blowing the vessel hull dry with a stream of air after removing said paint wherein a chloride level on said hull is less than about ten micrograms per square centimeter and wherein the hull has a paint adhesion value greater than 700 pounds per square inch;

collecting the water containing particles of the paint removed from the vessel hull;

transferring said water to a particle separating means;

separating the water from the paint particles by the particle separating means to form recyclable water;

collecting said paint particles by a collecting means for disposal; and pumping the recyclable water to a water storage means; and recycling the water to the water jet to remove additional paint.

6. The method of claim 5, wherein the water directing means is a nozzle, said nozzle being symmetrical and having a central axis, proximate and distal ends and further having a central conduit for passage of pressurized water, and a plurality of orifices in said nozzle distal end wherein each of said orifices is connected to said central conduit by a radial port, wherein the orifices have a central axis which is oblique to the central axis of said nozzle and forms an annular stream of water, said oblique angle of said orifice central axis directs the stream of pressurized water to a working surface wherein said annular streams cooperatively score said working surface.

7. A method for removing paint from a metal vessel hull, the method comprising the steps of:

directing a water jet of sufficient pressure to remove said paint from said vessel hull to fully expose the metal hull substrate, said water jet issuing from a symmetrical rotating nozzle housing having a central axis, proximate and distal ends, and a plurality of orifices, each of said orifices having a central axis laying on a line oblique to said central axis of said housing; and then blowing the vessel hull dry with a stream of air to remove said surface coating and water, wherein a chloride level on said hull is less than about 10 micrograms per cubic centimeter and the hull has a paint adhesion value greater than about 700 pounds per square inch.

8. The method of claim 7, further comprising the steps of:

collecting the water and surface coating particles removed from the vessel hull;

transferring the water and surface coating particles into a water transfer means;

separating the water from said surface coating particles by a particle separating means to prepare recyclable water;

collecting said surface coating particles; and then pumping the recyclable water to a water storage means.

9. The method of claim 8, further comprising the step of:

recycling said water from the water storage means to the water jet to remove additional paint.

* * * * *